US006675410B1

(12) United States Patent
Hennings

(10) Patent No.: US 6,675,410 B1
(45) Date of Patent: Jan. 13, 2004

(54) LOFT APPARATUS

(75) Inventor: Eric D. Hennings, 1970 Garner Ave., Moville, IA (US) 51039

(73) Assignee: Eric D. Hennings, Moville, IA (US)

( * ) Notice: Subject to any disclaimer, the term of this patent is extended or adjusted under 35 U.S.C. 154(b) by 0 days.

(21) Appl. No.: 10/278,457

(22) Filed: Oct. 23, 2002

(51) Int. Cl.[7] ..... A47C 19/20
(52) U.S. Cl. ..... 5/9.1; 5/200.1; 5/8
(58) Field of Search ..... 5/9.1, 8, 2.1, 10.1, 5/11, 200.1, 202

(56) References Cited

U.S. PATENT DOCUMENTS

| | | | | |
|---|---|---|---|---|
| 767,680 A | | 8/1904 | Barton | |
| 1,102,027 A | | 6/1914 | Farrington | |
| 1,278,568 A | | 9/1918 | Basile | |
| 1,285,309 A | | 11/1918 | Moberg | |
| 1,285,909 A | | 11/1918 | Bloom | |
| D55,928 S | | 8/1920 | Brown | |
| 2,945,241 A | * | 7/1960 | Sideroff | 5/8 |
| 3,725,966 A | | 4/1973 | Blecker | |
| 3,855,654 A | | 12/1974 | Pivacek | |
| 4,179,763 A | * | 12/1979 | Echavarren et al. | 5/8 |
| 5,483,707 A | * | 1/1996 | Meyer et al. | 5/9.1 |
| 5,575,023 A | * | 11/1996 | McCumber | 5/9.1 |
| 5,842,586 A | * | 12/1998 | Melby | 211/187 |
| 6,292,959 B1 | * | 9/2001 | Rosenquist | 5/9.1 |

* cited by examiner

*Primary Examiner*—Teri Pham Luu
*Assistant Examiner*—Fredrick Conley

(57) ABSTRACT

A loft apparatus for providing a bed loft that is collapsible The loft apparatus includes a frame assembly being designed for supporting the mattress. A plurality of hinge portions are coupled to the frame assembly. The hinge portions downwardly extend from the frame assembly whereby the hinge portions are designed for engaging the floor and support the frame assembly above the floor. A plurality of leg portions are pivotally coupled to the hinge portions. Each of the leg portions is pivotal between a stored position and a deployed position. The stored position is defined by each of the leg portions being positioned substantially parallel to the frame assembly. The deployed positioned is defined by the leg portions extending downwardly from the hinge portions whereby the leg portions are designed for engaging the floor and raising the frame assembly and the hinge portions above the floor.

20 Claims, 6 Drawing Sheets

LOFT APPARATUS

BACKGROUND OF THE INVENTION

1. Field of the Invention

The present invention relates to folding bed units and more particularly pertains to a new loft apparatus for providing a bed loft that is collapsible.

2. Description of the Prior Art

The use of folding bed units is known in the prior art. U.S. Pat. No. 4,179,763 describes a system for collapsing a bunk bed into a single bed unit. Another type of folding bed unit is U.S. Pat. No. 2,945,241 having an upper mattress support frame that can be selectively positioned over a lower mattress support frame to form a single bed or a bunk bed arrangement. U.S. Pat. No. 3,725,966 has a structural rail connected to a box spring with a leg structure coupled to the structural rail whereby the leg structure is selectively pivoted to support the box spring. U.S. Pat. No. 3,855,654 has a rail assembly that can be coupled to bed and can be stored under the bed when the rail assembly is not being used. U.S. Pat. No. 1,278,568 has a bed frame that is foldable to facilitate storing of the bed frame when not in use. U.S. Pat. No. 1,285,909 has a crib that is convertible to a couch or bed for an adult user. U.S. Pat. No. 1,102,027 has a crib that is foldable to facilitate storage of the crib when not in use. U.S. Pat. No. 767,680 has a metallic bedstead that is collapsible. U.S. Pat. No. Des. 55,928 shows a bed.

While these devices fulfill their respective, particular objectives and requirements, the need remains for a device that has certain improved features allows a second bed to be positioned under the first bed without the second bed being coupled to the first bed.

SUMMARY OF THE INVENTION

The present invention meets the needs presented above by providing a pair of leg portions that are positioned at an obtuse angle to the frame assembly when the leg portions are in the deployed position to allow a bed to be placed on the floor between the leg portions.

Still yet another object of the present invention is to provide a new loft apparatus that provides storage for the railing portions when the railing portions are not being used.

To this end, the present invention generally comprises a frame assembly being designed for supporting the mattress. A plurality of hinge portions are coupled to the frame assembly. The hinge portions downwardly extend from the frame assembly whereby the hinge portions are designed for engaging the floor and support the frame assembly above the floor. A plurality of leg portions are pivotally coupled to the hinge portions. Each of the leg portions is pivotal between a stored position and a deployed position. The stored position is defined by each of the leg portions being positioned substantially parallel to the frame assembly. The deployed positioned is defined by the leg portions extending downwardly from the hinge portions whereby the leg portions are designed for engaging the floor and raising the frame assembly and the hinge portions above the floor. The hinge portions positioning each of the leg portions at an obtuse angle from the frame assembly whereby the leg portions are designed for permitting insertion of another bed between the leg portions when the leg portions are in the deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
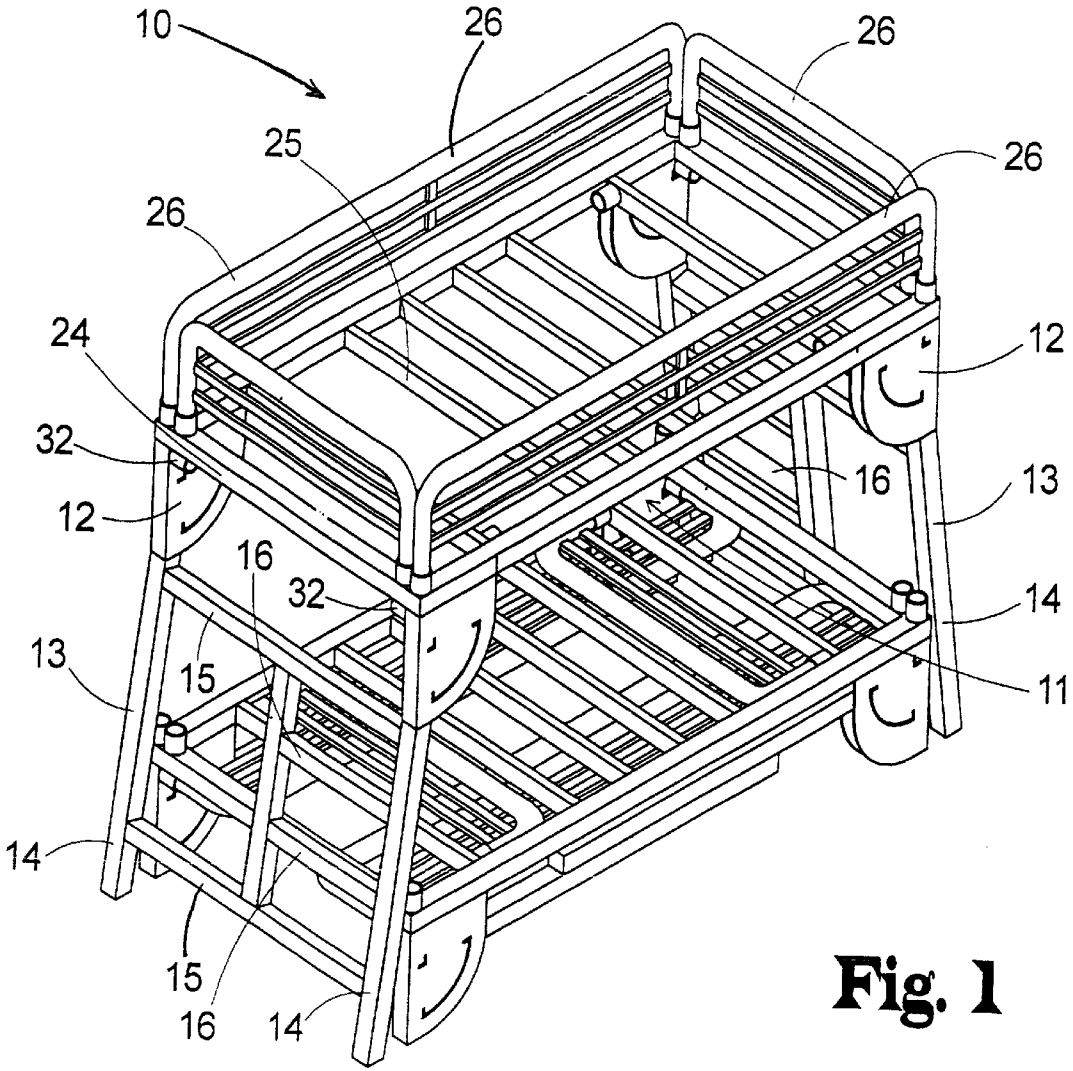
FIG. 1 is a perspective view of a new loft apparatus according to the present invention shown with a second loft apparatus positioned between the leg portions.
Figure 2:
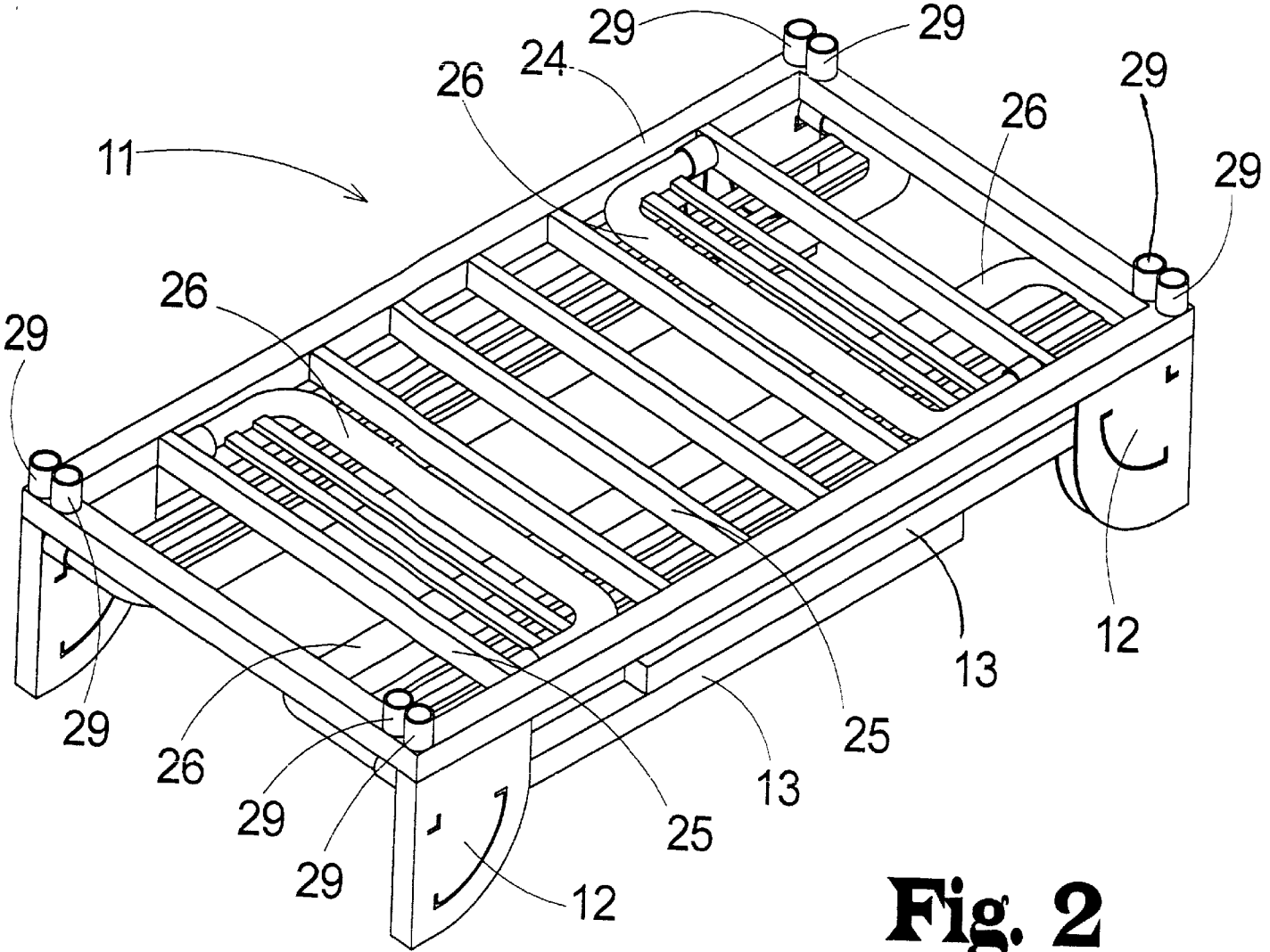
FIG. 2 is a perspective view of the present invention showing the leg portions in the storage position.
Figure 3:
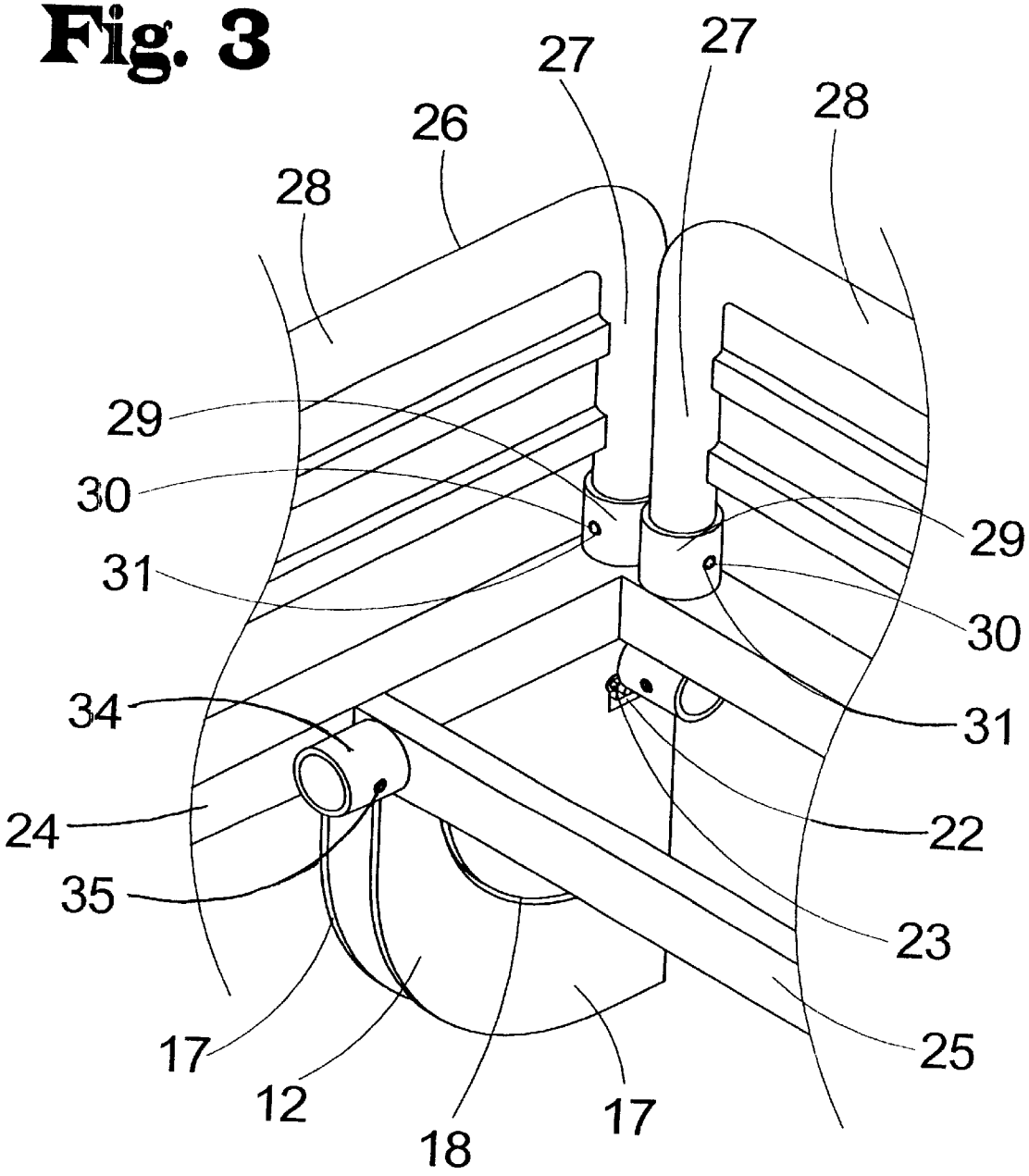
FIG. 3 is an enlarged perspective view of the rail portions and receiving members of the present invention.
Figure 4:
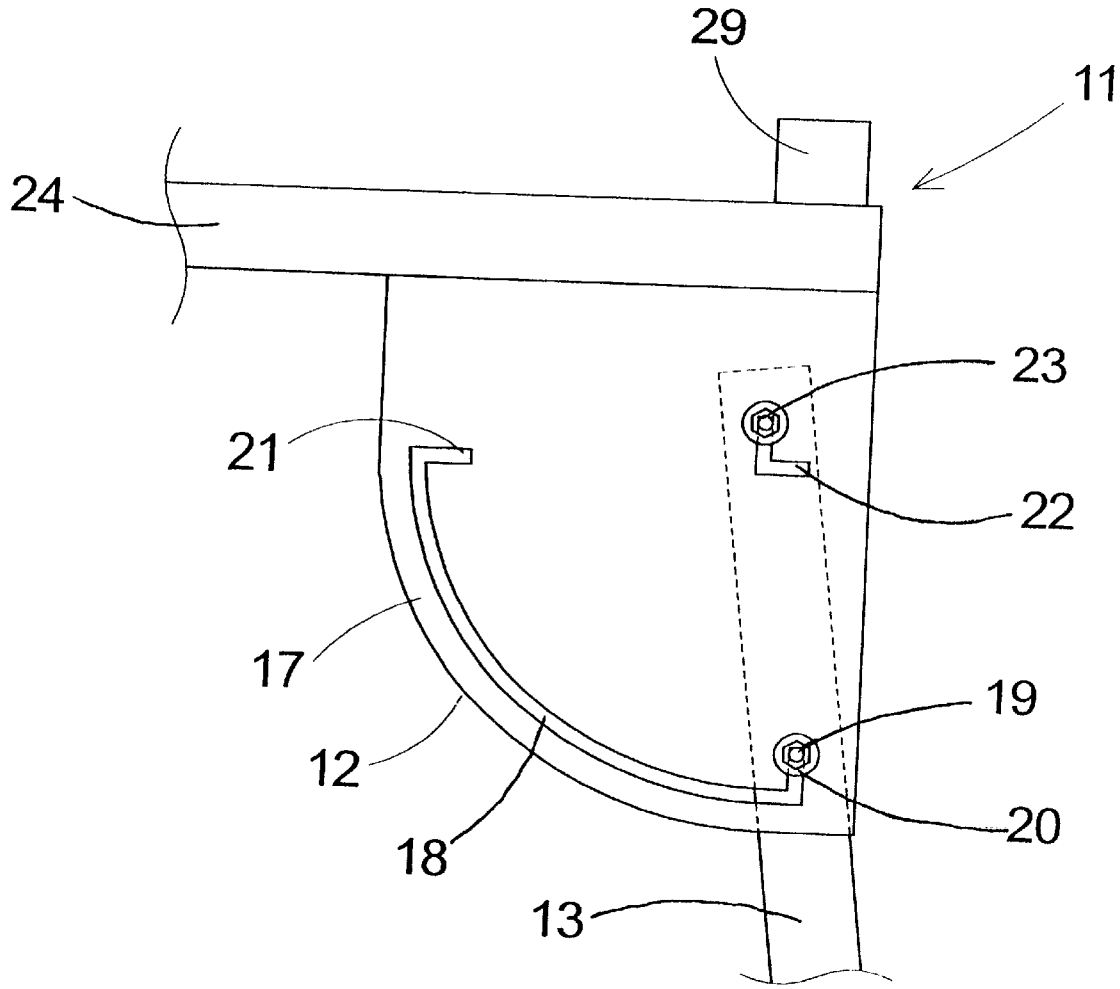
FIG. 4 is a side view of one of the hinge portions of the present invention.

With reference now to the drawings, and in particular to FIGS. 1 through 6 thereof, a new loft apparatus embodying the principles and concepts of the present invention and generally designated by the reference numeral 10 will be described.

As best illustrated in FIGS. 1 through 6, the loft apparatus 10 generally comprises a frame assembly 11 being designed for supporting the mattress.

A plurality of hinge portions 12 are coupled to the frame assembly 11. The hinge portions 12 downwardly extend from the frame assembly 11 whereby the hinge portions 12 are designed for engaging the floor and support the frame assembly 11 above the floor.

A plurality of leg portions 13 are pivotally coupled to the hinge portions 12. Each of the leg portions 13 is pivotal between a stored position and a deployed position. The stored position is defined by each of the leg portions 13 being positioned substantially parallel to the frame assembly 11. The deployed positioned is defined by the leg portions 13 extending downwardly from the hinge portions 12 whereby the leg portions 13 are designed for engaging the floor and raising the frame assembly 11 and the hinge portions 12 above the floor. The hinge portions 12 positioning each of the leg portions 13 at an obtuse angle from the frame assembly 11 whereby the leg portions 13 are designed for permitting insertion of another bed between the leg portions 13 when the leg portions 13 are in the deployed position.

Each of the leg portions 13 comprises a pair of leg stanchions 14. Each of the leg stanchions 14 is pivotally coupled to one of the hinge portions 12. Each of the leg stanchions 14 is designed for extending between the floor and an associated one of the hinge portions 12 when the leg portions 13 are pivoted to the deployed position.

Each of the leg portions 13 comprises a plurality of leg support members 15. The leg support members 15 are coupled between the leg stanchions 14 of the associated one of the leg portions 13. The leg support members 15 are for maintaining alignment of the leg stanchions 14 when the leg portions 13 are pivoted. The leg support members 15 are for inhibiting spreading apart of the leg stanchions 14 when a user is laying on the mattress supported by the frame assembly 11.

Each of the leg portions 13 comprises a plurality of ladder rungs 16. Each of the ladder rungs 16 is coupled to at least one of the leg stanchions 14 of the associated one of the leg portions 13. Each of the ladder rungs 16 is designed for supporting a user climbing the ladder rungs 16 to reach the mattress supported by the frame assembly 11 when the leg portions 13 are pivoted into the deployed position.

Each of the hinge portions 12 comprises a pair of plate members 17. Each of the plate members 17 is coupled to the frame assembly 11. Each of the leg stanchions 14 of the associated one of the leg portions 13 is pivotally coupled to the plate members 17 whereby each of the leg stanchions 14 is positioned between the plate members 17 of the associated one of the hinge portions 12. Each of the plate members 17 is designed for engaging the floor and positioning the frame assembly 11 above the floor when the leg portions 13 are in the stored position.

Each of the plate members 17 comprises an arcuate slot 18. The arcuate slot 18 extends through the associated one of the plate members 17 whereby the arcuate slot 18 of one of the plate members 17 is aligned with the arcuate slot 18 of the other of the plate members 17 of the associated one of the hinge portions 12.

Each of the hinge portions 12 comprises a guide fastener 19. The guide fastener 19 is coupled to the associated one of the leg stanchions 14 whereby the guide fastener 19 extends through the arcuate slot 18 of each of the plate members 17 of the associated one of the hinge portions 12. The guide fastener 19 is for sliding in the arcuate slot 18 when the associated one of the leg portions 13 is pivoted with respect to the frame assembly 11.

Each of the plate members 17 comprises a deploy slot 20. The deploy slot 20 is in communication with the arcuate slot 18 of the associated one of the plate members 17. The guide fastener 19 slides into the deploy slot 20 of the associated one of the plate members 17 when the leg portions 13 are pivoted into the deployed position. The deploy slot 20 extends towards the frame member from the arcuate slot 18 of the associated one of the plate members 17 whereby the guide fastener 19 is slid out of the arcuate slot 18 for inhibiting inadvertent pivoting of the leg portions 13 when the user is positioned on the mattress.

Each of the plate members 17 comprises a storage slot 21. The storage slot 21 is in communication with the arcuate slot 18 of the associated one of the plate members 17 whereby the storage slot 21 is positioned opposite the deploy slot 20 of the associated one of the plate members 17. The guide fastener 19 slides into the storage slot 21 of the associated one of the plate members 17 when the leg portions 13 are pivoted into the storage position. The storage slot 21 extends substantially parallel to the frame member from the arcuate slot 18 of the associated one of the plate members 17 whereby the guide fastener 19 is slid out of the arcuate slot 18 for inhibiting inadvertent pivoting of the leg portions 13 when leg portions 13 are in the storage position.

The deployed slot of each of the plate members 17 is positioned at the obtuse angle from the frame assembly 11. The deployed slot is for positioning the leg portions 13 at the obtuse angle to the frame assembly 11 when the leg portions 13 are pivoted into the deployed position.

Each of the plate members 17 comprises a pivot slot 22. The pivot slot 22 extends through the associated one of the plate members 17. A pivot pin 23 is coupled to the associated one of the leg stanchions 14 and extends through the pivot slot 22 of each of the plate members 17 of the associated one of the hinge portions 12 whereby the pivot pin 23 slides and pivots in the pivot slot 22 when the associated one of the leg portions 13 is pivoted with respect to the frame assembly 11.

The frame assembly 11 comprises a perimeter member 24 and a plurality of frame support members 25. The hinge portions 12 are coupled to the perimeter member 24. Each of the frame support members 25 extends between sides of the perimeter member 24. Each of the frame support members 25 is for stabilizing the perimeter member 24 when the user is positioned on the mattress supported by the frame assembly 11. Each of the frame support members 25 is designed for being positioned under the mattress whereby the frame support members 25 support the mattress when the mattress is positioned on the frame assembly 11.

A plurality of railing portions 26 are selectively coupled to the perimeter member 24 of the frame assembly 11. Each of the railing portions 26 upwardly extends from the frame assembly 11 whereby the railing portions 26 are designed for inhibiting the user from inadvertently falling off of the mattress.

Each of the railing portions 26 comprises a pair of side members 27 and at least one rail member 29. The rail member 29 extends between the side members 27. The side members 27 is selectively coupled to the perimeter member 24 of the frame assembly 11.

A plurality of receiving members are coupled to the perimeter member 24 of the frame assembly 11. Each of the receiving members is designed for slidably receiving one of the side members 27 of the associated one of the railing portions 26 whereby the railing portions 26 extend upwardly from the perimeter member 24 of the frame assembly 11.

Each of the side members 27 of the railing portion comprises a locking pin 30 biased outwardly from the associated one of the side members 27. The locking pin 30 selectively extends through a locking aperture 31 of the associated one of the receiving members whereby the locking pin 30 selectively secures the associated one of the railing portions 26 to the frame assembly 11. The locking pin 30 is designed for being pressed by the user to slide the locking pin 30 out of the locking aperture 31 to allow the associated one of the railing portions 26 to be removed from the frame assembly 11.

A plurality of side storage receivers 32 are coupled to the hinge portions 12. Each of the side storage receivers 32 selectively receives one of the side members 27 of the associated one of the railing portions 26 comprising a length substantially equal to a length of the frame assembly 11 whereby the railing portions 26 are positioned under and substantially parallel to the frame assembly 11 for facilitating storage when the user is not using the railing portions 26.

Each of the side storage receivers 32 comprises a side locking orifice 33. The side locking orifice 33 selectively receives the locking pin 30 of the associated one of the side members 27 for selectively securing the associated one of the railing portions 26 to the side storage receivers 32 when the associated one of the railing portions 26 is not being used by the user.

A plurality of end storage receivers 34 are coupled to the frame support members 25. Each of the end storage receivers 34 selectively receives one of the side members 27 of the associated one of the railing portions 26 comprising a length substantially equal to a width of the frame assembly 11 whereby the railing portions 26 are positioned between adjacent frame support members 25 of the frame assembly 11 for facilitating storage when the user is not using the railing portions 26.

Each of the end storage receivers 34 comprises an end locking orifice 35. The end locking orifice 35 selectively receives the locking pin 30 of the associated one of the side members 27 for selectively securing the associated one of the railing portions 26 to the end storage receivers 34 when the associated one of the railing portions 26 is not being used by the user.

Figure 5:
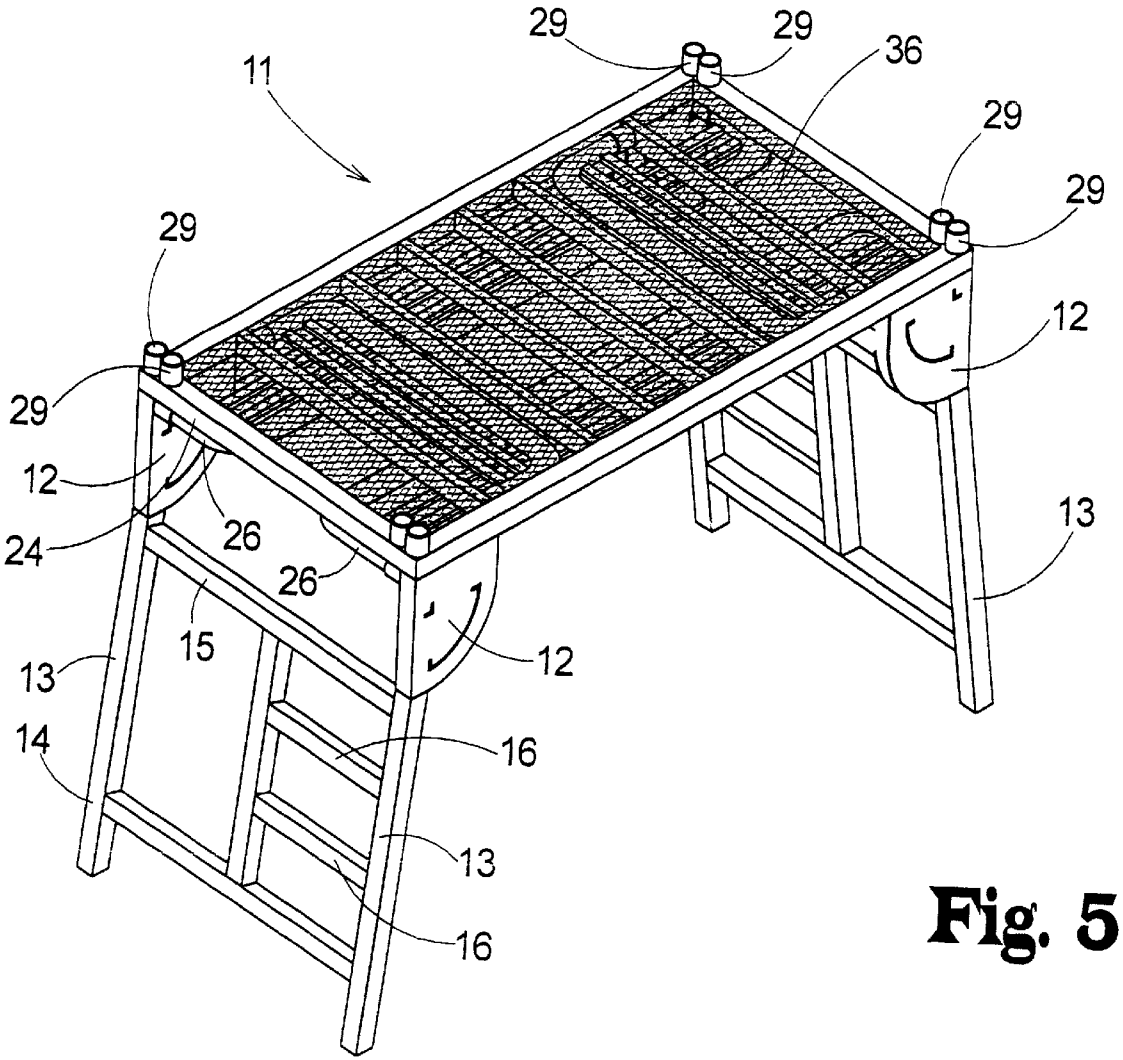
FIG. 5 is a perspective view of an embodiment of the present invention.
Figure 6:
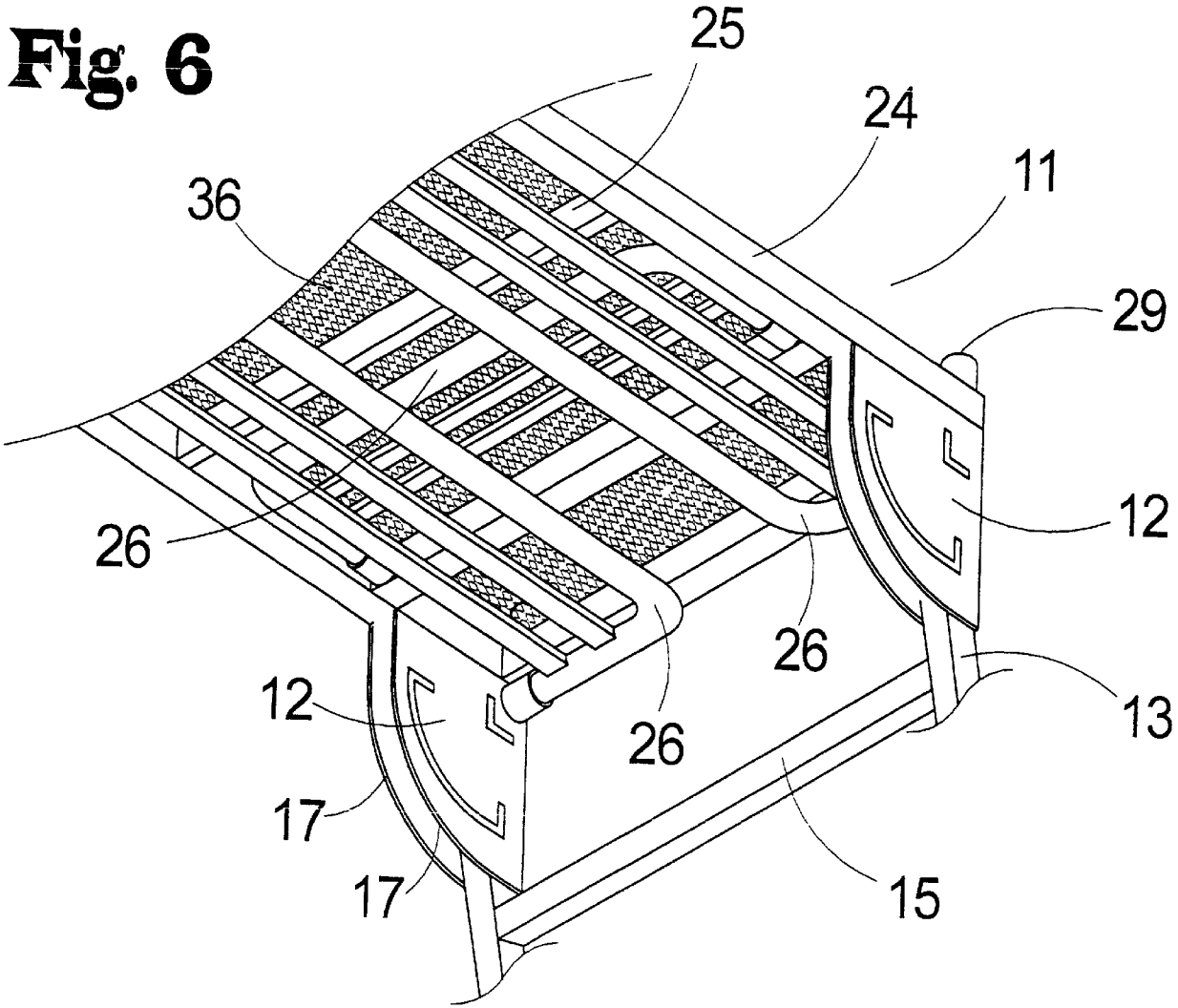
FIG. 6 is an enlarged perspective view of the present invention shown the rail portions in the stored position.

In an embodiment, as shown in FIGS. 5 and 6, a grate member 36 is selectively positioned on the support members of the frame assembly 11 whereby the perimeter member 24 of the frame assembly 11 extends around the grate member 36. The grate member 36 is designed for supporting the mattress whereby the grate member 36 supports across the entire mattress to inhibit pressure points being formed by the frame support members 25 when the user is laying on the mattress.

In use, the user pulls each of the leg portions 13 away from the associated one of the hinge portions 12 so that the leg portions 13 can be pivoted away from the frame assembly 11. Each of the leg portions 13 is then pushed towards the frame assembly 11 to lock the leg portions 13 in the deployed position. The frame assembly 11 and hinge portions 12 are now positioned above the floor. The user may then slide as second loft apparatus between the leg portions 13 of the first loft apparatus so that the first loft apparatus is lofted above the second loft apparatus. The railing portions 26 may then be removed as needed and coupled to the perimeter member 24 of the frame assembly 11 to provide the user some protection from inadvertently falling off the mattress.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A loft apparatus for supporting a mattress above a floor, the loft apparatus comprising:

a frame assembly being adapted for supporting the mattress;

a plurality of hinge portions being coupled to said frame assembly, said hinge portions downwardly extending from said frame assembly such that said hinge portions are adapted for engaging the floor and support said frame assembly above the floor; and a plurality of leg portions being pivotally coupled to said hinge portions, each of said leg portions being pivotal between a stored position and a deployed position, said stored position being defined by each of said leg portions being positioned substantially parallel to said frame assembly, said deployed positioned being defined by said leg portions extending downwardly from said hinge portions such that said leg portions are adapted for engaging the floor and raising said frame assembly and said hinge portions above the floor, said hinge portions positioning each of said leg portions at an obtuse angle from said frame assembly such that said leg portions are adapted for permitting insertion of another bed between said leg portions when said leg portions are in said deployed position.

2. The loft apparatus as set forth in claim 1, further comprising:

each of said leg portions comprising a pair of leg stanchions, each of the leg stanchions being pivotally coupled to one of said hinge portions, each of said leg stanchions being adapted for extending between the floor and an associated one of said hinge portions when said leg portions are pivoted to said deployed position.

3. The loft apparatus as set forth in claim 2, further comprising:

each of said leg portions comprising a plurality of leg support members, said leg support members being coupled between said leg stanchions of the associated one of said leg portions, said leg support members being for maintaining alignment of said leg stanchions when said leg portions are pivoted, said leg support members being for inhibiting spreading apart of said leg stanchions when a user is laying on the mattress supported by said frame assembly.

4. The loft apparatus as set forth in claim 2, further comprising:

each of said leg portions comprising a plurality of ladder rungs, each of said ladder rungs being coupled to at least one of said leg stanchions of the associated one of the leg portions, each of said ladder rungs being adapted for supporting a user climbing said ladder rungs to reach the mattress supported by said frame assembly when said leg portions are pivoted into said deployed position.

5. The loft apparatus as set forth in claim 2, further comprising:

each of said hinge portions comprising a pair of plate members, each of said plate members being coupled to said frame assembly, each of said leg stanchions of the associated one of said leg portions being pivotally coupled to said plate members such that each of said leg stanchions is positioned between said plate members of the associated one of said hinge portions, each of said plate members being adapted for engaging the floor and positioning said frame assembly above the floor when said leg portions are in said stored position.

6. The loft apparatus as set forth in claim 5, further comprising:

each of said plate members comprising an arcuate slot, said arcuate slot extending through the associated one of said plate members such that said arcuate slot of one of said plate members is aligned with said arcuate slot of the other of said plate members of the associated one of said hinge portions; and each of said hinge portions comprising a guide fastener, said guide fastener being coupled to the associated one of said leg stanchions such that said guide fastener extends through said arcuate slot of each of said plate members of the associated one of said hinge portions, said guide fastener being for sliding in said arcuate slot when the associated one of said leg portions is pivoted with respect to said frame assembly.

7. The loft apparatus as set forth in claim 6, further comprising:

each of said plate members comprising a deploy slot, said deploy slot being in communication with said arcuate slot of the associated one of said plate members, said guide fastener sliding into said deploy slot of the associated one of said plate members when said leg portions are pivoted into said deployed position, said deploy slot extending towards said frame member from said arcuate slot of the associated one of said plate members such that said guide fastener is slid out of said arcuate slot for inhibiting inadvertent pivoting of said leg portions when the user is positioned on the mattress.

8. The loft apparatus as set forth in claim 7, further comprising:

each of said plate members comprising a storage slot, said storage slot being in communication with said arcuate slot of the associated one of said plate members such that said storage slot is positioned opposite said deploy slot of the associated one of said plate members, said guide fastener sliding into said storage slot of the associated one of said plate members when said leg portions are pivoted into said storage position, said storage slot extending substantially parallel to said frame member from said arcuate slot of the associated one of said plate members such that said guide fastener is slid out of said arcuate slot for inhibiting inadvertent pivoting of said leg portions when leg portions are in said storage position.

9. The loft apparatus as set forth in claim 8, further comprising:

each of said plate members comprising a pivot slot, said pivot slot extending through the associated one of said plate members, a pivot pin being coupled to the associated one of said leg stanchions and extends through said pivot slot of each of said plate members of the associated one of said hinge portions such that said pivot pin slides and pivots in said pivot slot when the associated one of said leg portions is pivoted with respect to said frame assembly.

10. The loft apparatus as set forth in claim 7, further comprising:

said deployed slot of each of said plate members being positioned at the obtuse angle from said frame assembly, said deployed slot being for positioning said leg portions at the obtuse angle to said frame assembly when said leg portions are pivoted into said deployed position.

11. The loft apparatus as set forth in claim 1, further comprising:

said frame assembly comprising a perimeter member and a plurality of frame support members, said hinge portions being coupled to said perimeter member, each of said frame support members extending between sides of said perimeter member, each of said frame support members being for stabilizing said perimeter member when the user is positioned on the mattress supported by said frame assembly, each of said frame support members being adapted for being positioned under the mattress such that said frame support members support the mattress when the mattress is positioned on said frame assembly.

12. The loft apparatus as set forth in claim 11, further comprising:

a grate member being selectively positioned on said support members of said frame assembly such that said perimeter member of said frame assembly extends around said grate member, said grate member being adapted for supporting the mattress such that said grate member supports across the entire mattress to inhibit pressure points being formed by said frame support members when the user is laying on the mattress.

13. The loft apparatus as set forth in claim 11, further comprising:

a plurality of railing portions being selectively coupled to said perimeter member of said frame assembly, each of said railing portions upwardly extending from said frame assembly such that said railing portions are adapted for inhibiting the user from inadvertently falling off of said mattress.

14. The loft apparatus as set forth in claim 13, further comprising:

each of said railing portions comprising a pair of side members and at least one rail member, said rail member extending between said side members, said side members being selectively coupled to said perimeter member of said frame assembly.

15. The loft apparatus as set forth in claim 14, further comprising:

a plurality of receiving members are coupled to said perimeter member of said frame assembly, each of said receiving members being adapted for slidably receiving one of said side members of the associated one of said railing portions such that said railing portions extend upwardly from said perimeter member of said frame assembly.

16. The loft apparatus as set forth in claim 15, further comprising:

each of said side members of said railing portion comprising a locking pin biased outwardly from the associated one of said side members, said locking pin selectively extending through a locking aperture of the associated one of said receiving members such that said locking pin selectively secures the associated one of said railing portions to said frame assembly, said locking pin being adapted for being pressed by the user to slide said locking pin out of the locking aperture to allow the associated one of said railing portions to be removed from said frame assembly.

17. The loft apparatus as set forth in claim 14, further comprising:

a plurality of side storage receivers being coupled to said hinge portions, each of said side storage receivers selectively receiving one of said side members of the associated one of said railing portions comprising a length substantially equal to a length of said frame assembly such that said railing portions are positioned under and substantially parallel to said frame assembly for facilitating storage when the user is not using said railing portions.

18. The loft apparatus as set forth in claim 14, further comprising:

a plurality of end storage receivers being coupled to said frame support members, each of said end storage receivers selectively receiving one of said side members of the associated one of said railing portions comprising a length substantially equal to a width of said frame assembly such that said railing portions are positioned between adjacent frame support members of said frame assembly for facilitating storage when the user is not using said railing portions.

19. A loft apparatus for supporting a mattress above a floor, the loft apparatus comprising:

a frame assembly being adapted for supporting the mattress;

a plurality of hinge portions being coupled to said frame assembly, said hinge portions downwardly extending from said frame assembly such that said hinge portions are adapted for engaging the floor and support said frame assembly above the floor;

a plurality of leg portions being pivotally coupled to said hinge portions, each of said leg portions being pivotal between a stored position and a deployed position, said stored position being defined by each of said leg portions being positioned substantially parallel to said frame assembly, said deployed positioned being defined by said leg portions extending downwardly from said hinge portions such that said leg portions are adapted for engaging the floor and raising said frame assembly and said hinge portions above the floor, said hinge portions positioning each of said leg portions at an obtuse angle from said frame assembly such that said leg portions are adapted for permitting insertion of another bed between said leg portions when said leg portions are in said deployed position;

each of said leg portions comprising a pair of leg stanchions, each of the leg stanchions being pivotally coupled to one of said hinge portions, each of said leg stanchions being adapted for extending between the floor and an associated one of said hinge portions when said leg portions are pivoted to said deployed position;

each of said leg portions comprising a plurality of leg support members, said leg support members being coupled between said leg stanchions of the associated one of said leg portions, said leg support members being for maintaining alignment of said leg stanchions when said leg portions are pivoted, said leg support members being for inhibiting spreading apart of said leg stanchions when a user is laying on the mattress supported by said frame assembly;

each of said leg portions comprising a plurality of ladder rungs, each of said ladder rungs being coupled to at least one of said leg stanchions of the associated one of the leg portions, each of said ladder rungs being adapted for supporting a user climbing said ladder rungs to reach the mattress supported by said frame assembly when said leg portions are pivoted into said deployed position;

each of said hinge portions comprising a pair of plate members, each of said plate members being coupled to said frame assembly, each of said leg stanchions of the associated one of said leg portions being pivotally coupled to said plate members such that each of said leg stanchions is positioned between said plate members of the associated one of said hinge portions, each of said plate members being adapted for engaging the floor and positioning said frame assembly above the floor when said leg portions are in said stored position;

each of said plate members comprising an arcuate slot, said arcuate slot extending through the associated one of said plate members such that said arcuate slot of one of said plate members is aligned with said arcuate slot of the other of said plate members of the associated one of said hinge portions;

each of said hinge portions comprising a guide fastener, said guide fastener being coupled to the associated one of said leg stanchions such that said guide fastener extends through said arcuate slot of each of said plate members of the associated one of said hinge portions, said guide fastener being for sliding in said arcuate slot when the associated one of said leg portions is pivoted with respect to said frame assembly;

each of said plate members comprising a deploy slot, said deploy slot being in communication with said arcuate slot of the associated one of said plate members, said guide fastener sliding into said deploy slot of the associated one of said plate members when said leg portions are pivoted into said deployed position, said deploy slot extending towards said frame member from said arcuate slot of the associated one of said plate members such that said guide fastener is slid out of said arcuate slot for inhibiting inadvertent pivoting of said leg portions when the user is positioned on the mattress;

each of said plate members comprising a storage slot, said storage slot being in communication with said arcuate slot of the associated one of said plate members such that said storage slot is positioned opposite said deploy slot of the associated one of said plate members, said guide fastener sliding into said storage slot of the associated one of said plate members when said leg portions are pivoted into said storage position, said storage slot extending substantially parallel to said frame member from said arcuate slot of the associated one of said plate members such that said guide fastener is slid out of said arcuate slot for inhibiting inadvertent pivoting of said leg portions when leg portions are in said storage position;

said deployed slot of each of said plate members being positioned at the obtuse angle from said frame assembly, said deployed slot being for positioning said leg portions at the obtuse angle to said frame assembly when said leg portions are pivoted into said deployed position;

each of said plate members comprising a pivot slot, said pivot slot extending through the associated one of said plate members, a pivot pin being coupled to the associated one of said leg stanchions and extends through said pivot slot of each of said plate members of the associated one of said hinge portions such that said pivot pin slides and pivots in said pivot slot when the associated one of said leg portions is pivoted with respect to said frame assembly;

said frame assembly comprising a perimeter member and a plurality of frame support members, said hinge portions being coupled to said perimeter member, each of said frame support members extending between sides of said perimeter member, each of said frame support members being for stabilizing said perimeter member when the user is positioned on the mattress supported by said frame assembly, each of said frame support members being adapted for being positioned under the mattress such that said frame support members support the mattress when the mattress is positioned on said frame assembly;

a plurality of railing portions being selectively coupled to said perimeter member of said frame assembly, each of said railing portions upwardly extending from said frame assembly such that said railing portions are adapted for inhibiting the user from inadvertently falling off of said mattress;

each of said railing portions comprising a pair of side members and at least one rail member, said rail member extending between said side members, said side members being selectively coupled to said perimeter member of said frame assembly;

a plurality of receiving members are coupled to said perimeter member of said frame assembly, each of said receiving members being adapted for slidably receiving one of said side members of the associated one of said railing portions such that said railing portions extend upwardly from said perimeter member of said frame assembly;

each of said side members of said railing portion comprising a locking pin biased outwardly from the associated one of said side members, said locking pin selectively extending through a locking aperture of the associated one of said receiving members such that said locking pin selectively secures the associated one of said railing portions to said frame assembly, said locking pin being adapted for being pressed by the user to slide said locking pin out of the locking aperture to allow the associated one of said railing portions to be removed from said frame assembly;

a plurality of side storage receivers being coupled to said hinge portions, each of said side storage receivers selectively receiving one of said side members of the associated one of said railing portions comprising a length substantially equal to a length of said frame assembly such that said railing portions are positioned under and substantially parallel to said frame assembly for facilitating storage when the user is not using said railing portions;

each of said side storage receivers comprising a side locking orifice, said side locking orifice selectively receiving said locking pin of the associated one of said side members for selectively securing the associated one of said railing portions to said side storage receivers when the associated one of said railing portions is not being used by the user;

a plurality of end storage receivers being coupled to said frame support members, each of said end storage receivers selectively receiving one of said side members of the associated one of said railing portions comprising a length substantially equal to a width of said frame assembly such that said railing portions are positioned between adjacent frame support members of said frame assembly for facilitating storage when the user is not using said railing portions; and each of said end storage receivers comprising an end locking orifice, said end locking orifice selectively receiving said locking pin of the associated one of said side members for selectively securing the associated one of said railing portions to said end storage receivers when the associated one of said railing portions is not being used by the user.

20. The loft apparatus as set forth in claim 19, further comprising:

a grate member being selectively positioned on said support members of said frame assembly such that said perimeter member of said frame assembly extends around said grate member, said grate member being adapted for supporting the mattress such that said grate member supports across the entire mattress to inhibit pressure points being formed by said frame support members when the user is laying on the mattress.

* * * * *